US005462798A

United States Patent [19]

Gueret

[11] Patent Number: 5,462,798

[45] Date of Patent: Oct. 31, 1995

[54] BRUSH FOR APPLYING A LIQUID PRODUCT AS A LAYER ON A SUBSTRATE

[75] Inventor: Jean-Louis H. Gueret, Paris, France

[73] Assignee: L'Oreal, Paris, France

[21] Appl. No.: 266,617

[22] Filed: Jun. 28, 1994

Related U.S. Application Data

[62] Division of Ser. No. 90,120, Jul. 21, 1993, abandoned.

[30] Foreign Application Priority Data

Jan. 8, 1992 [FR] France ..... 92 00131

[51] Int. Cl.[6] ..... D02G 3/00

[52] U.S. Cl. ..... 428/364; 428/361; 204/157.1; 15/183; 15/192; 15/194; 15/159.1

[58] Field of Search ..... 428/364, 361; 204/157.6; 423/447, 448; 300/17, 18, 19, 20, 21; 15/159 R, 183, 192, 191 R, 194, 195, 159 A, 160

[56] References Cited

U.S. PATENT DOCUMENTS 3,604,043 9/1971 Lewis ..... 15/159

FOREIGN PATENT DOCUMENTS 0329505 8/1989 European Pat. Off. .
57-183419 11/1982 Japan .
61-199740 9/1986 Japan .

*Primary Examiner*—Patrick J. Ryan
*Assistant Examiner*—Merrick Dixon
*Attorney, Agent, or Firm*—Young & Thompson

[57] ABSTRACT

The invention relates to a monofilament fiber made of plastic containing from 0.2 to 15% by weight of at least one agent improving the slip characteristic of the fiber and reducing its wettability by water and/or by solvents. The invention also relates to an applicator for liquid product, the applicator being a plurality of hairs joined mechanically to the same single member in which at least a proportion of the hairs consists of lengths of a fiber such as defined above. These applicators are particularly advantageous for the application of cosmetic products.

10 Claims, No Drawings

BRUSH FOR APPLYING A LIQUID PRODUCT AS A LAYER ON A SUBSTRATE

This application is a division of application Ser. No. 08/090,120, filed July 21, 1993, abandoned.

The present invention relates to a new brush made of fiber which have particularly advantageous characteristics. The invention finds a particularly advantageous application in the field of the application of brushes for the application of cosmetic products.

It is known that a number of cosmetic products are presented in the form of more or less thick liquid and must be distributed as uniformly as possible over a substrate. This is the case, for example with a nail varnish, which must be deposited uniformly on the nail by means of a paintbrush to form a film. It is also the case with a liquid mascara, which must be deposited on the eyelashes by means of a brush. In all cases it is desirable to retain on the applicator only a minimum quantity of product to be distributed and, consequently, attempts are made, on the one hand, to reduce the wettability of the hairs of the applicator by the product to be distributed and, on the other hand, to improve the slip of the product on the fiber of which the hairs consist so as to limit the attachment of the said product as much as possible. It is quite clear that the results set out above are also desirable in fields other than the application of cosmetic products, with the result that the invention could not be limited to this field alone.

The subject of the present invention is therefore a brush each of whose bristles is a monofilament fiber made of plastic which has any cross-section, the circular envelope of which has a diameter of between 0.03 and 0.40 mm, characterized in that the plastic of which the fiber consists contains from 0.2 to 15% by weight of at least one agent improving the slip characteristic of the fiber and reducing its wettability by water and/or by solvents.

In a preferred embodiment of the invention the slip agent is chosen from the group consisting of teflon, boron nitride, molybdenum disulfide, graphites, fullerene and talc. The section of the fiber may be of any form, in particular flat, circular, polygonal, cruciform, annular or U-shaped; the fiber may also comprise at least one capillary channel of straight or undulating linear shape and the section of which may not be symmetrical. The plastic of which the fiber consists is advantageously chosen from the group consisting of polyamides, polyesters, polyether-block-amides and polytetrafluoroethylene. When the fiber consists of a polyamide it is possible to employ polyamides 6, 6-6, 6-10, 6-12 or 11, in particular. The end of the fiber may be treated, for example by milling, or with heating.

The brush of the present invention is an applicator for liquid product, comprising a plurality of hairs joined mechanically to the same single member, the maneuvering of which makes it possible to distribute the product as a layer on a substrate, characterized in that at least a proportion of the hairs of the applicator consists of lengths of fibers as defined above.

According to a first alternative form, the brush according to the invention is a paintbrush in which the hairs are substantially parallel and carried by a handle: this is the case, in particular, with an applicator for nail varnish. According to a second alternative form, the applicator according to the invention forms a hairbrush in which the hairs are implanted in tufts onto a support such as a plate. According to a third alternative form the applicator according to the invention forms a brush in which the hairs are clasped via their central region in a core, the hairs having approximately one radial direction in relation to the core; in this alternative form the core may consist of a twisted metal wire from 0.3 to 0.9 mm in diameter, the hairs of the brush being locked into the twists of the core: this is the case, in particular, with a mascara brush.

In a brush according to the invention it is possible for only a proportion of the hairs to consist of fibers according to the invention. The fibers which have improved slip characteristics may be either mixed randomly with fibers of conventional type, of the same section as the section of the fiber with improved slip characteristics, or of different section, or else, on the other hand, localized in certain areas of the applicator. For example, in the case of a paintbrush or nail varnish, the middle part of the paintbrush may consist of fibers of conventional type whereas the peripheral part consists of fibers with high slip characteristic.

It has been found that the use of the fibers according to the invention for the production of cosmetics applicators has very significant advantages. Firstly, the product is better distributed on the hairs of the applicator, and this makes it possible to employ hairs of larger diameter, on the one hand, and to increase the speed of application of the product onto the substrate, on the other hand. In addition, the product has a greater tendency to remain on the substrate than on the hairs of the applicator, and this makes it possible to effect a distribution as a thicker layer. In the particular case of mascara brushes, especially of the spiral type, it is known that mascara containers comprise diaphragms used for drying the brush each time it is taken out of the container; it was found that with the fibers according to the invention the drying distributed the product perfectly over the hairs of the brush and that, in addition, the brush was less fouled and therefore less contaminated, given that the product slips along the hairs at each application and is uniformly renewed instead of forming residues along the hairs. It was also found that the application of mascara to eyelashes is performed more softly and gives rise to a more uniform film.

In the case of the paintbrushes for nail varnish or for eyeliner, it was found that the use of the fibers according to the invention made possible a fast and uniform distribution of the product even if the hairs of the hairbrush were greater than usual in diameter. The layer deposited onto the substrate is generally thicker than with the applicators of the state of the art.

To make the subject of the invention better understood, a description of three embodiments thereof will now be given by way of examples which are purely illustrative and do not imply any limitation.

EXAMPLE 1

A spiral brush is made, intended for making up eyelashes by means of a liquid mascara consisting of an aqueous composition which has a viscosity of 90 poises (9 Pa s). The hairs of the brush consist of nylon 6-10 polyamide fibers containing 8% by weight of boron nitride $(BN)_6$.

The brush consists of a core made of twisted iron wire which has a diameter of 0.7 mm, the twists of the core holding via their central region approximately 500 hairs which are distributed uniformly into 17 turns corresponding to the twists of the core. The brush has a cylindrical shape 26 mm in length and 6.5 mm in diameter. The hairs of the brush have a diameter of 0.15 mm and their section is a solid circular section. It is found that, on such a brush, the turn effect is fairly unpronounced, and this makes it possible, in a known manner, to obtain a make-up of good quality.

It is found that the use of the fibers containing boron nitride as indicated above makes it possible to improve appreciably the softness of the make-up, its uniformity and its speed. In addition, after a given number of applications, the brush is less fouled in the vicinity of the core which, in the case of a brush of identical construction produced with hairs consisting of lengths of fibers which have the same characteristics, except that they do not contain any boron nitride.

EXAMPLE 2

Fibers are made of polyester containing 10% by weight of teflon. These fibers have a cruciform cross-section contained in a circular envelope which has a diameter of 0.15 mm.

A paintbrush consisting of parallel hairs with a length of 17 mm is produced by means of these fibers. This paintbrush comprises 150 hairs.

The paintbrush is employed with a nail varnish which has a viscosity of 4 poises (0.4 Pa s). It is found that the layer of nail varnish obtained on a nail is perfectly distributed and thicker than with the paintbrushes of the state of the art.

EXAMPLE 3

Fibers are made of polyether-block-amide containing 6% by weight of molybdenum disulfide. These fibers have a circular cross-section and comprise a lengthwise capillary groove. The diameter of the cross-section is approximately 0.3 mm; on the periphery of the fiber the capillary groove has a width of approximately 0.06 mm, and this groove has a depth of approximately 0.06 mm.

The fibers defined above are employed for producing the hairs of a hairbrush. Each hair has a length of 35 mm above the plate which forms the support. The hairs are implanted in tufts of 10 hairs, the positioning of the hairs being performed, in a known manner, by bending lengths of fibers of double length into a U and by driving the tufts into a housing by means of a lug inserted by force.

Such a brush is employed for spreading a treatment product which has a viscosity of 3 poises (0.3 Pa s) seconds over the head of hair of a person. It is found that the coating of the head of hair is performed more uniformly than with a brush of the state of the art and that the brushing of the hair is more pleasant for the person being treated.

It is obvious that the embodiments described above are not limiting in any way and will be capable of giving rise to any desirable modification with departing thereby from the scope of the invention.

I claim:

1. A brush for applying a thick liquid cosmetic product as a layer on a substrate, comprising a multiplicity of hairs joined mechanically to a single base member, at least some of the hairs being of monofilament fiber of plastic having a diameter between 0.03 and 0.40 mm, the plastic of said fiber containing 0.2 to 15% by weight of at least one agent improving the slip characteristic of the fiber and reducing its wettability, thereby to reduce the quantity of said thick liquid cosmetic product that is retained on the brush when the brush is used to apply said thick liquid cosmetic product to said substrate.

2. A brush according to claim 1, wherein said agent is selected from the group consisting from teflon, boron nitride, molybdenum disulfide, graphite, fullerene and talc.

3. A brush according to claim 1, wherein the section of said fiber is flat, circular, polygonal, cruciform, annular or U-shaped.

4. A brush according to claim 1, wherein said fiber has at least one capillary channel.

5. A brush according to claim 1, wherein said plastic is selected from the group consisting of polyamide, polyester, polyetherblock-amide and polytetrafluoroethylene.

6. A brush according to claim 1, wherein said plastic is polyamide selected from the group consisting of polyamide 6, polyamide 6-6, polyamide 6-10, polyamide 6-12 and polyamide 11.

7. A brush according to claim 1, in the form of a paint brush in which said fibers are substantially parallel and carried by a handle.

8. A brush according to claim 1, in the form of a hair brush and said fibers are implanted in tufts in a support.

9. A brush according to claim 1, whose fibers are clasped via their central region in a core, the fibers having substantially one radial direction relative to said core.

10. A brush according to claim 9, wherein said core is a twisted metal wire from 0.3 to 0.9 mm in diameter, said fibers being locked into the twists of the core.

* * * * *